US008393275B2

(12) United States Patent
Jacobi et al.

(10) Patent No.: US 8,393,275 B2
(45) Date of Patent: Mar. 12, 2013

(54) LONGITUDINALLY SPINNING SUSPENSION ROLLER COASTER

(75) Inventors: Timothy R. Jacobi, Hyde Park, UT (US); Stanley J. Checketts, Providence, UT (US)

(73) Assignee: S & S Worldwide, Inc., Logan, UT (US)

( * ) Notice: Subject to any disclaimer, the term of this patent is extended or adjusted under 35 U.S.C. 154(b) by 141 days.

(21) Appl. No.: 12/666,978

(22) PCT Filed: Jul. 1, 2008

(86) PCT No.: PCT/US2008/068926

§ 371 (c)(1),
(2), (4) Date: Dec. 28, 2009

(87) PCT Pub. No.: WO2009/006480

PCT Pub. Date: Jan. 8, 2009

(65) Prior Publication Data

US 2010/0326312 A1 Dec. 30, 2010

Related U.S. Application Data

(60) Provisional application No. 60/958,267, filed on Jul. 2, 2007.

(51) Int. Cl.
*A63G 7/00* (2006.01)

(52) U.S. Cl. ..... 104/53; 104/63

(58) Field of Classification Search ..... 104/53, 104/55, 56, 57, 63, 64, 74, 75, 76, 77, 78, 104/80, 81; 472/30, 32, 34, 35, 37, 38, 39, 472/44, 47, 3, 1

See application file for complete search history.

(56) References Cited

U.S. PATENT DOCUMENTS

| | | | | | |
|---|---|---|---|---|---|
| 2,547,152 | A * | 4/1951 | Burg | 472/1 |
| 2,659,601 | A * | 11/1953 | Siverts | 472/39 |
| 3,356,365 | A * | 12/1967 | De Shano | 472/37 |
| 5,791,998 | A * | 8/1998 | Moser et al. | 472/31 |
| 6,022,276 | A * | 2/2000 | Knijpstra | 472/33 |
| 6,315,674 | B1 * | 11/2001 | Slade et al. | 472/131 |
| 6,523,479 | B1 * | 2/2003 | Schilke et al. | 104/57 |
| 7,594,473 | B2 * | 9/2009 | Kitchen et al. | 104/53 |
| 7,610,859 | B1 * | 11/2009 | Dietrich | 104/53 |
| 7,846,032 | B2 * | 12/2010 | Zamperla et al. | 472/34 |
| 7,918,740 | B2 * | 4/2011 | Kitchen et al. | 472/36 |
| 8,066,576 | B2 * | 11/2011 | Threlkel | 472/47 |
| 2002/0042303 | A1 * | 4/2002 | Larson et al. | 472/44 |

* cited by examiner

*Primary Examiner* — Mark Le
(74) *Attorney, Agent, or Firm* — Richard D. Clarke

(57) ABSTRACT

A roller coaster or amusement ride providing a unique free-floating sensation by extending the passenger vehicles out on either side of the central frame structure. The passenger vehicles (48, 50) are supported between two cushioned cantilevered vehicle support arms {34, 36) that pivot while being supported between air bags (30, 32} or springs. The air pressure in the air bags or the tension in the springs can be adjusted to provide a soft, free-floating sensation to the ride. Additional passenger vehicle motions are achieved by the omni-directional ball-swivel joints (38, 40) on the ends of the support arms. The off-center location of the passenger vehicles (48, 50) and the weight of the passengers enable the passenger vehicles to remain in the up¬ right position even when the central frame structure rotates around the track system. No additional drive systems or passenger controls are required on this unique roller coaster ride.

22 Claims, 5 Drawing Sheets

LONGITUDINALLY SPINNING SUSPENSION ROLLER COASTER

FIELD OF THE INVENTION

The longitudinally spinning suspension roller coaster relates broadly to a dynamic amusement or thrill ride of the type wherein a passenger-carrying ride vehicle is caused to move along a track structure in a generally closed loop with more or less inclined portions and a series of curves and spirals. More particularly, the invention pertains to a cantilevered longitudinally spinning and rocking roller coaster system enhancing the sensation of motion and travel experienced by passengers in the ride vehicles.

BACKGROUND OF THE INVENTION

Amusement parks are enjoying a continuously increasing success throughout the country, as well as throughout the rest of the world. These parks offer their guests a wide range of attractions, the most popular and most spectacular of which is certainly recognized as the roller coaster. Traditionally, roller coasters comprise one or more ride vehicles traveling along rails or tracks in the manner of a train. The passengers appreciate this attraction for the strong impressions it produces beyond the real sensations of acceleration along the path of travel. Traditional roller coasters enable thrilling motions along loops, spirals and curves to be integrated into the ride, although a generally jarring and bumping sensation is very common.

Another type of ride comprises a vehicle supported on and guided along a tubular track structure. The side mounting of the ride vehicle on the track may provide passengers with the sensation that the ride vehicle does not ride on a track structure and seems to be free from any mechanical tether to any visible or predetermined course. However, because of the need to maintain control and safety of the ride vehicles, the most severe spirals and loops designed into traditional roller coasters have not typically been present in these alternate ride systems. As a result, the range of sensations offered to passengers is reduced with the passengers sensation of motion generally dictated by the velocity, acceleration and positioning of the ride vehicle in direct juxtaposition to its path of travel. When it is technically impossible to increase the ride experience of such ride systems, rides with a theme are used to present amusing and entertaining backdrops, scenery, lighting, sound and other special effects.

Notwithstanding these attempts to amplify the thrill of a ride in roller coasters and in alternate ride systems, there remains a definite need for an amusement ride that is capable of enhancing the overall sensation of the motion and travel experienced by a passenger as the ride vehicle moves along its particular track structure. That is, it remains desirable to provide an amusement ride, which creates an impression of free flight and keeps the track structure away from the passenger sight line. There also exists a need to provide an amusement ride which permits the ride vehicle to be accelerated in ways uncommon to prior art roller coaster designs.

Numerous innovations for roller coaster rides have been provided in the prior art that are described as follows. Even though these innovations may be suitable for the specific individual purposes to which they address, they differ from the present invention as hereinafter contrasted. The following is a summary of those prior art patents most relevant to the invention at hand, as well as a description outlining the difference between the features of the present invention and those of the prior art.

U.S. Pat. No. 5,791,254 of John F. Mares et al, describes a roller coaster or amusement park ride that is comprised of a track system capable of directional travel, including horizontal, vertical, angled, curved, curvilinear, and retrograde directions. A carriage in which passengers reside is relatable about the track system, either by programming or by passenger activation, providing for additional freedom of movement. The roller coaster may have, a track through a clear tube (e.g., surrounded by water) and multiple; independent rides supported by the same support structure, providing increased excitement for the passengers.

This patent describes a unique track system and passenger carriage but does not provide the free floating, sensation derived by when the passenger vehicles are located on the end of the cantilevered air cushioned arms extending out from the central coaster structure using a variety of rotating axis points.

U.S. Pat. No. 6,047,645 of Joseph M. Cornwell describes an amusement ride system and in particular, amusement ride systems of the roller coaster type. More specifically, the present invention relates to a truss track assembly for use in transporting side-mount passenger vehicles.

This patent describes a roller coaster ride system with a unique track assembly using multiple rigidly side mounted vehicles. The ride vehicles or structure has no cushioning capabilities and the movements are limited to the configuration of the track assembly, which at times can produce a jarring sensation.

U.S. Pat. No. 6,098,549 of John F. Mares describes an amusement device comprising a modularized pod, in which one or more riders sit and are restrained, and which spins under power about a horizontal axis according to the passenger's active control. The riders control the spinning of the pod, either forward or backward, by pressing buttons on the passenger's handgrips located inside the pod. The modularized pod may be used in conjunction with many different types of amusement devices, including, but not limited, to roller coasters, carousels, Ferris wheels, virtual reality units, and centrifugal tumblers. The modularized pod may also be used in conjunction with flight and space training and simulation units.

This patent describes a modularized pod, with one or more riders, which spins sander power about a horizontal axis according, to the passenger's active control. It requires additional drive systems and control mechanisms for each passenger and does not have any of the air cushioning capabilities.

U.S. Pat. No. 6,523,479 of Alan Schilke et al. describes amusement rides and methods. The amusement rides of the present invention include roller coaster vehicles that have a controlled spin or controlled rotation in a direction or dimension independent from the track of the roller coaster. The controlled rotation or spin is provided by using displacement of the track configuration to power a proportional rotation of the vehicle This patent describes a roller coaster vehicle having a controlled spin independent from the track, but it has no air hag cushioning capabilities and thus produces a rough ride.

None of the foregoing prior art teaches or suggests the particular unique features of the longitudinally spinning suspension roller coaster and thus clarifies the need for further improvements in these types of thrill rides.

In this respect, before explaining at least one embodiment of the longitudinally spinning suspension roller coaster in detail it is to be understood that the design is not limited in its application to the details of construction and to the arrangement of the components set forth in the following description or illustrated in the drawings. The longitudinally spinning suspension roller coaster is capable of other embodiments and of being practiced and carried out in various ways. In addition, it is to be understood that the phraseology and terminology employed herein are for the purpose of description and should not be regarded as limiting.

SUMMARY OF THE INVENTION

The principle advantage of the longitudinally spinning suspension roller coaster is to provide a unique air cushioned floating sensation on a roller coaster ride which spins longitudinally and yet the riders and seats within the passenger vehicle remain in the upright position throughout the ride.

Another advantage is to produce a floating sensation with the ride vehicles suspended away from the central rail system on cantilevered spring cushioned or air cushioned support arms.

Another advantage is to produce a ride that can be tailored to the age of the individuals using the ride where short small systems will work well for younger children and higher, longer and more articulated systems will work for teens and adults.

And still another advantage is to create a ride where the vehicle is maintained on a general longitudinal axis with the rail system, while allowing a limited spring cushioned or air cushioned rocking motion.

A further advantage is to create a ride with cantilevered vehicle support arms, where the amount of possible travel is much greater and the passenger vehicle is allowed to rock yet it is maintained in a general upright position.

And yet a further advantage of this longitudinally spinning suspension roller coaster is to add a new and unique thrill ride to the area of amusement park rides.

These together with other objects, along with the various features of novelty, which characterize the longitudinally spinning suspension roller coaster, are pointed out with particularity in the claims annexed to and forming a part of this disclosure. For a better understanding of the design, its operating advantages and the specific objects attained by its uses, reference should be made to the accompanying drawings and descriptive, matter in which there are illustrated the preferred embodiments. There has thus been outlined, rather broadly, the more important features of the invention in order that the detailed description thereof that follows may be better understood, and in order that the present contribution to the art may be better appreciated. There are additional features that will be described, hereinafter and which will form the subject matter of the claims appended hereto.

The preferred embodiment of the longitudinally spinning suspension roller coaster will consist of a forward structural Y-shaped member and a rear structural Y-shaped member that are joined by the means of a pivotal mechanism rod allowing each member to pivot independently conforming to the distorted configurations of the tubular rail system. The forward structural Y-shaped member and a rear structural Y-shaped member are symmetrical about the central pivotal mechanism rod. Each Y-shaped mechanism has two outboard segments. On the end of each outboard segment is a airbag-supporting, structure retaining the upper and lower air bags. Through the center of each of the outboard segments is located the air cushioned cantilevered vehicle support arm with omni-directional ball-swivel joint housings on the ends. An orifice in the mini-directional ball-swivel joint housings provides a means for the axles on the passenger vehicles to rotate. The air cushioned cantilevered vehicle support arms pivot on pivot pins while being supported on the upper and lower surfaces between the upper and lower air bags. The air pressure in the upper and lower an bags will be adjusted to provide a soft floating feeling to the ride. The off-center location of the passenger vehicles and the weight of the passengers, maintains the passenger vehicles generally in the up-right position, even if the longitudinally spinning suspension roller coaster rotates 360 degrees around the three-member tubular rail system. The passenger vehicles have the ability to rock up and down by the means of the air cushioned cantilevered vehicle support arms in the forward structural Y-shaped member and a rear structural Y-shaped member and the additional central pivot. This multiple axial combination provides an unmatched free-floating sensation for the passengers within the vehicles that are suspended away from the tubular rail system. The weight of the passengers and any additional movements they make will accentuate the cushioned movements of the passenger vehicles. No additional motion drive mechanisms are required to produce this unique roller coaster ride.

With respect to the above description then, it is to be realized that the optimum dimensional relationships for the parts of the longitudinally spinning suspension roller coaster, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present design. Therefore, the foregoing is considered as illustrative only of the principles of the design. Further, since numerous modifications and changes will readily occur to those skilled in the art, it is not desired to limit the longitudinally spinning suspension roller coaster to the exact construction and operation shown and described, and accordingly, all suitable modifications and equivalents may be resorted to, falling within the scope of the design features.

BRIEF DESCRIPTION OF THE DRAWINGS

The accompanying drawings, which are incorporated in and form a part of this specification, illustrate embodiments of the longitudinally spinning suspension roller coaster and together with the description, serve to explain the unique principles of the design.

DETAILED DESCRIPTION OF THE PREFERRED EMBODIMENTS

As required, detailed embodiments of the longitudinally spinning, suspension roller coaster 10 are disclosed herein, however, it is to be understood that the disclosed embodiments are merely exemplary of the design that may be embodied in various forms. Therefore, specific functional and structural details disclosed herein are not to be interpreted as limiting, but merely as basic for the claims and as a representative basis for teaching one skilled in the art to variously employ the present design in virtually any appropriately detailed structure.

Figure 1:
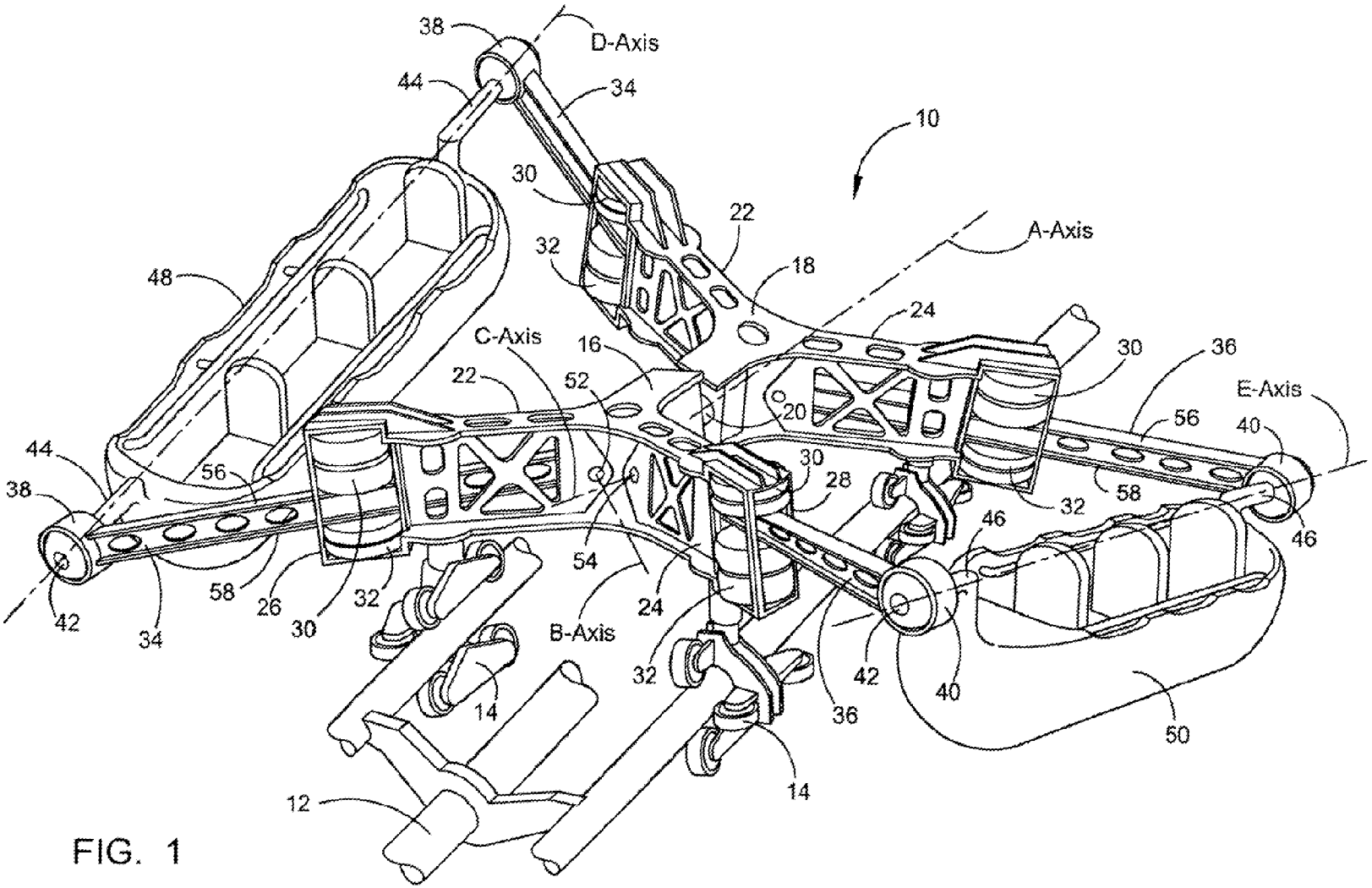
FIG. 1 depicts a perspective view of the longitudinally spinning suspension roller coaster on a conventional three-member tubular rail system.

Referring now to the drawings, wherein similar parts of the longitudinally spinning suspension roller coaster 10 are identified by like reference numerals, there is seen in FIG. 1 a perspective view of the longitudinally spinning suspension roller coaster 10 on a conventional three-member tubular rail system 12. It must be understood at this time, although the three-member tubular rail system 12 has been depicted, a wide variety of combinations in number and shape of tubular rail systems along with a variety of different conventional tracks and propulsion systems will work well with the longitudinally spinning suspension roller coaster 10 and thus will be covered within the scope of this patent. A variety of conventional roller coaster trucks 14 are used on roller coasters and will work equally as well with the longitudinally spinning suspension roller coaster 10.

A forward structural Y-shaped member 16 and a rear structural Y-shaped member 18 are joined by the means of a pivotal mechanism rod 20 along the central A-Axis allowing each member to pivot independently conforming to the distorted configurations of the three-member tubular rail system 12. The forward structural Y-shaped member 16 and a rear structural Y-shaped member 18 are symmetrical about the pivotal mechanism rod 20 so that a full description of the forward structural Y-shaped member 16 will suffice for the description of the rear structural Y-shaped member 18. There is a structural member outboard segment 22 and 24 on each side of the forward Y-shaped member 16. On the end of each structural member outboard segment 22 and 24 are the airbag supporting structures 26 and 28 retaining the upper air bags 30 and the lower air bags 32. Though the center of the each of the outboard segments 22 and 24 and between the upper airbag 30 and the lower airbag 32 is located, the air cushioned cantilevered vehicle support arms 34 and 36. On the ends of each of the vehicle support arms 34 and 36 are omni-directional ball-swivel joint housings 38 and 40. A ball swivel joint orifice 42 in the omni-directional ball-swivel joint housings 38 and 40 provides a means for the axles 44 and 46 on the passenger vehicles 48 and 50 to rotate about the D and E-Axes.

The air cushioned cantilevered vehicle support arms 34 and 36 pivot about the B and C-Axes on pivot pins 52 and 54 supported on the upper and lower surfaces 56 and 58 between the upper and lower air bags 30 and 32. The air pressure in the upper and lower air bags 30 and 32 will be adjusted to provide a soft, floating feeling to the ride. It is anticipated that other cushioning mechanisms could be employed, such as any springs or spring-like mechanisms suitable for this purpose. Also, it is possible to orient the suspension system in the vertical direction, as well as the horizontal direction (as illustrated), or it could be oriented in the direction of travel on a cantilever arm.

The off-center location of the passenger vehicles 48 and 50, in relation to the D and E-Axes and the weight of the passengers, maintains the passenger vehicles 48 and 50 generally staying in the up-right position, even if the longitudinally spinning suspension roller coaster 10 rotates 360 degrees around the three-member tubular rail system 12. In is typical of many roller coaster rides to provide sections of track which twist 360 degrees and thereby guide the passenger vehicle to do a full circle around the track structure. In the present invention, this can occur with the riders remaining in the upright position during and throughout the full circle motion. Therefore, a novel feature of the present invention is that during longitudinal spin the seats in the passenger vehicle remain upright while the chassis rotates around the track.

The passenger vehicles 48 and 50 have the ability to rock up and down by the means of the air cushioned cantilevered vehicle support arms 34 and 36 in the forward structural Y-shaped member 16 and a rear structural Y-shaped member 18. This multiple axial combination provides an unmatched free-floating sensation fix the passengers within the vehicles 48 and 50 that are suspended away from the three-member tubular rail system 12. The weight of the passengers and any additional movements they make will accentuate the cushioned movements of the passenger vehicles 48 and 50. No additional motion drive mechanisms are required to produce this unique roller coaster ride.

Figure 2:
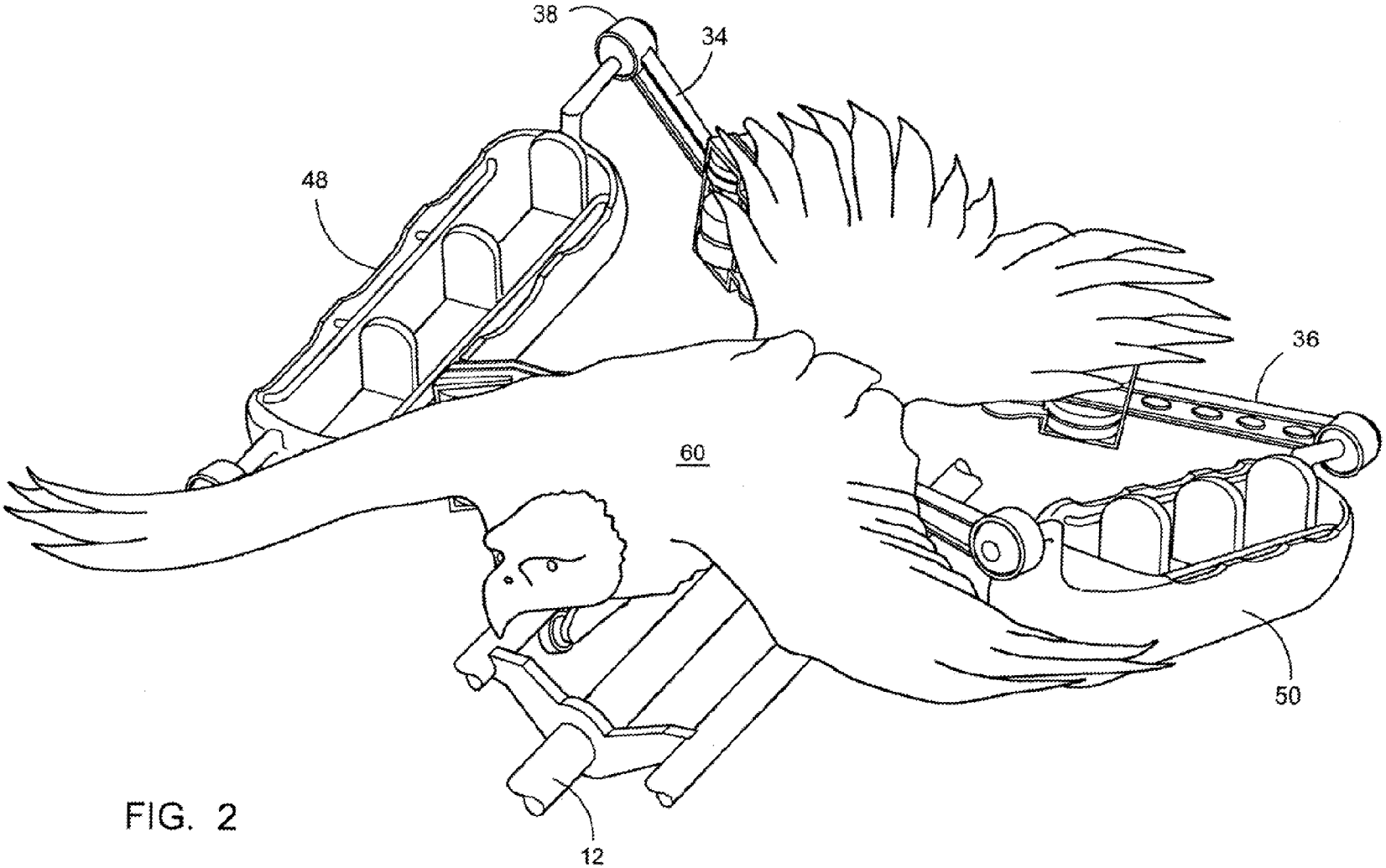
FIG. 2 depicts a perspective view of the longitudinally spinning suspension roller coaster with an eagle ornament.

FIG. 2 depicts a perspective view of the longitudinally spinning suspension roller coaster 10 with an eagle ornament 60. The free-floating sensation for the passengers within the vehicles 48 and 50 that are suspended away from the three-member tubular rail system 12 easily simulates the flight of a bird. This is where the eagle ornament 60 is used to cover the mechanical structure of the longitudinally spinning suspension roller coaster 10. A wide variety of differing theme ornaments can be used for this purpose and will still be covered within the scope of this patent.

Figure 3:
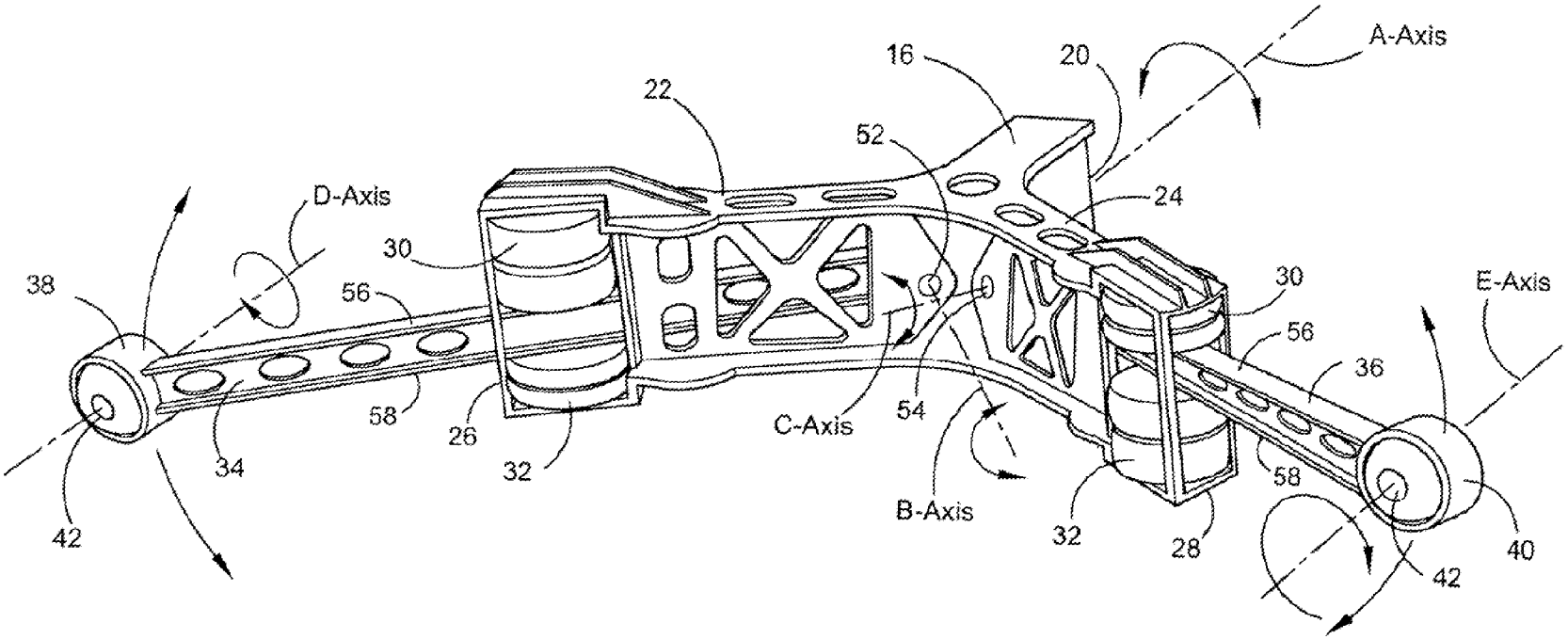
FIG. 3 depicts a perspective view of the forward structural Y-shaped member illustrating the varying pivotal axis points and the spring or air cushioned cantilevered vehicle support arms.

FIG. 3 depicts a perspective view of the forward structural Y-shaped member 16 illustrating the varying pivotal axis points with the direction of rotation. The forward structural Y-shaped member 16 and a rear structural Y-shaped member 18 are symmetrical about the pivotal mechanism rod 20. The air cushioned cantilevered vehicle support arms 34 and 36 are clearly displayed within the structural member outboard segments 22 and 24 with the upper surfaces 56 and lower surfaces 58 being supported by the means of the upper airbags 30 and the lower airbags 32. The up and down movement of the air cushioned cantilevered vehicle support arms 34 and 36 are illustrated pivoting on the B and C-Axes by the means of the pivot pins 52 and 54.

Figure 4A:
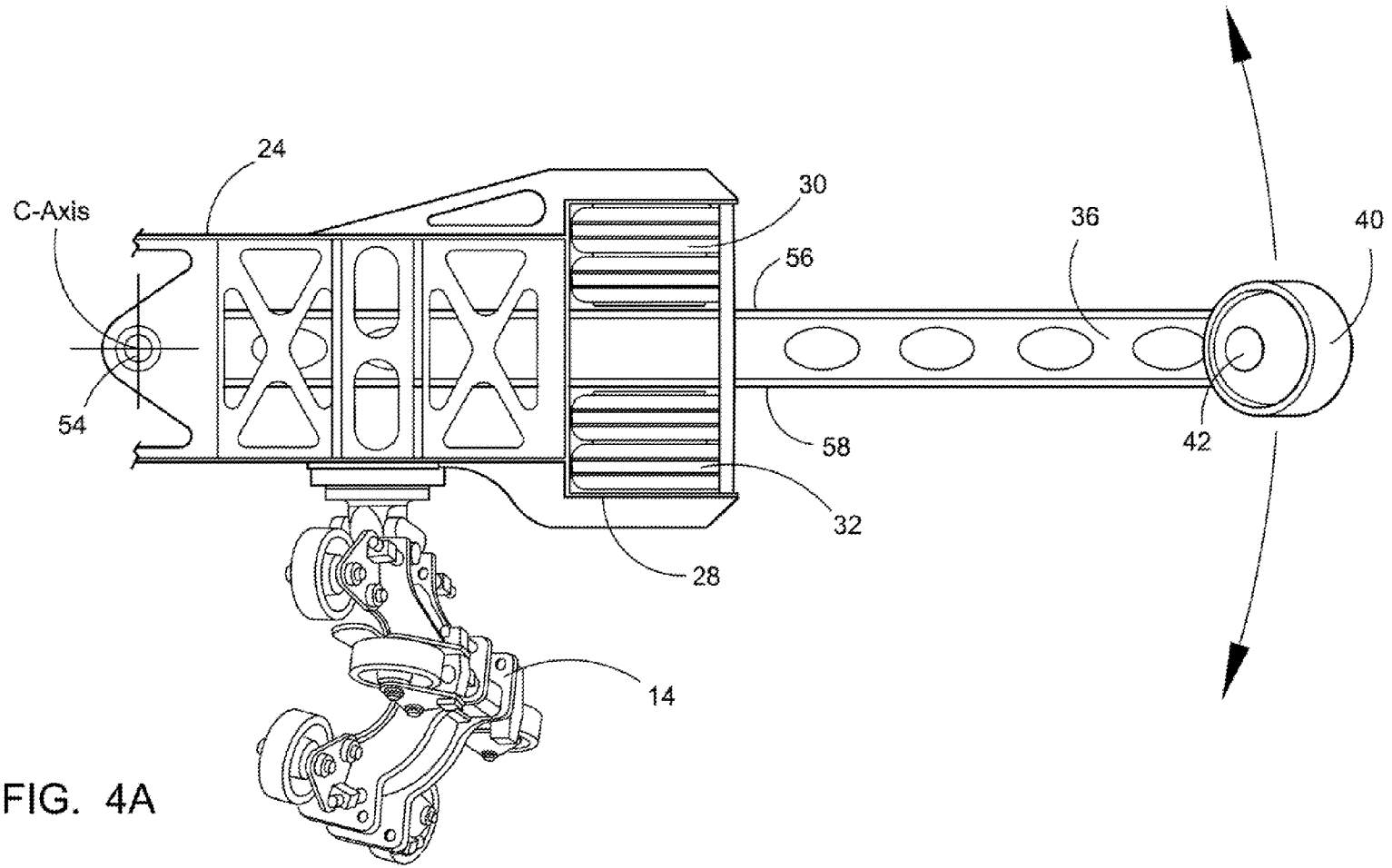
FIG. 4A depicts a side elevation of a portion of a structural Y-shaped member with the spring or air cushioned cantilevered vehicle support arm, showing airbag cushioning.

FIG. 4A depicts a side elevation of the structural member outboard segment 24 of the structural Y-shaped member 16 with the airbag air cushioned cantilevered vehicle support arm 36 further depicting the up and down movement compressing the upper and lower airbags 30 and 32 during the roller coaster ride.

Figure 4B:
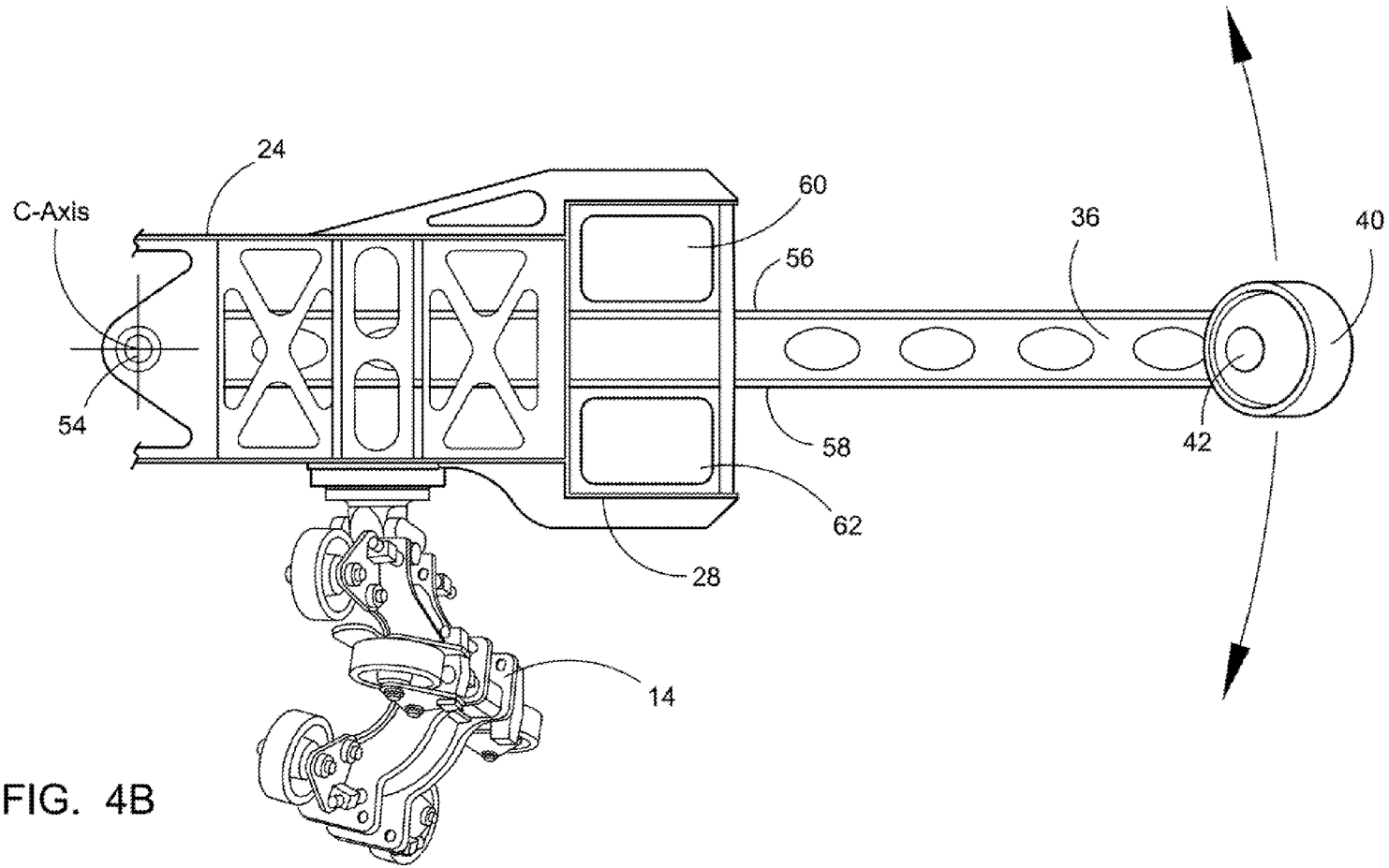
FIG. 4B depicts a side elevation of a portion of a structural Y-shaped member with the spring or air cushioned cantilevered vehicle support arm, showing spring cushioning.

FIG. 4B depicts a side elevation of the structural member outboard segment 24 of the structural Y-shaped member 16 with the spring air cushioned cantilevered vehicle support arm 36 further depicting the up and down movement compressing the upper and lower springs 60 and 62 during the roller coaster ride.

The longitudinally spinning suspension roller coaster 10 shown in the drawings and described in detail herein disclose arrangements of elements of particular construction and configuration for illustrating preferred embodiments of structure and method of operation of the present design. It is to be understood, however, that elements of different construction and configuration and other arrangements thereof, other than those illustrated and described may be employed for providing a longitudinally spinning suspension roller coaster 10 in accordance with the spirit of this design, and such changes, alternations and modifications as would occur to those skilled in the art are considered to be within the scope of these design features as broadly defined in the appended claims.

Further, the purpose of the foregoing abstract is to enable the Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the unique features of the application, which is measured by the claims, nor is it intended to be limiting as to the scope of the design in any way.

We claim:

1. A longitudinally spinning suspension roller coaster comprising:

(a) a forward structural Y-shaped members and a rear structural Y-shaped members both attached to a pivotal rod whereby said forward Y-shaped structural member and said rear Y-shaped structural member are symmetrical about said pivotal rod;

(b) a structural member outboard portion on each side of said forward Y-shaped member and said rear structural Y-shaped member having a cushion supporting structure attached to said structural member outboard portion;

(c) one or more upper cushions in a form of airbags or springs and one or more lower cushions in a form of airbags or springs, whereby said a cushion supporting structures retain both upper cushions and lower cushions therein;

(d) cantilevered vehicle support arms extending outward from said structural member outboard portions having a proximal end and a distal end, whereby said proximal end of said cantilevered support arms are located between said upper cushions and said lower cushions;

(e) omni-directional ball-swivel joint housings located on cantilevered vehicle support arms; and (f) passenger vehicles having passenger vehicle axles rotatably attached to said omni directional ball-swivel joint housings whereby said passenger vehicles rock up and down in said forward structural Y-shaped member and said rear structural Y-shaped member.

2. The longitudinally spinning suspension roller coaster according to claim 1, wherein said structural member outboard portion on each side of said forward Y-shaped member and said rear structural Y-shaped member each support a roller coaster truck movably attachable to a three-member tubular rail system.

3. The longitudinally spinning suspension roller coaster according to claim 1, said upper and lower cushions comprising upper springs and lower springs wherein said cushion supporting structures retain both said upper springs and lower springs.

4. The longitudinally spinning suspension roller coaster according to claim 1, wherein said cantilevered vehicle support arms extending outward from said structural member outboard portions are pivotally attached to said structural member outboard portions by pivot pins.

5. The longitudinally spinning suspension roller coaster according to claim 1, wherein said cantilevered vehicle support arms extending outward from said structural member outboard portions pass between said upper cushions and lower cushions to allow for cushioning of said cantilevered vehicle support arms movement.

6. The longitudinally spinning suspension roller coaster according to claim 3, wherein said cantilevered vehicle support arms extending outward from said structural member outboard portions pass between said upper springs and lower springs to allow for cushioning of said cantilevered vehicle support arms movement.

7. The longitudinally spinning suspension roller coaster according to claim 1, wherein said passenger vehicles having passenger vehicle axles rotatably attached to said omni-directional ball-swivel joint housings whereby said passenger vehicles rock up and down limited by the cushioned cantilevered vehicle support arms and said passenger vehicles remain in an upright position throughout a longitudinal spin of the roller coaster.

8. The longitudinally spinning suspension roller coaster according to claim 1, having a forward direction of travel along a three-member tubular rail system, wherein said passenger vehicle is oriented in said forward direction of travel when attached to said cantilevered vehicle support arms.

9. The longitudinally spinning suspension roller coaster according to claim 1, wherein said forward structural Y-shaped members and a rear structural Y-shaped members, said structural member outboard portions and said cantilevered vehicle support arms are partially hidden under an ornamental structure.

10. The longitudinally spinning suspension roller coaster according to claim 9, wherein said ornamental structure resembles a flying bird.

11. The longitudinally spinning suspension roller coaster according to claim 10, wherein said ornamental structure resembling a flying bird resembles an eagle.

12. A method for making a longitudinally spinning suspension roller coaster, comprising the steps of:

(a) providing forward structural Y-shaped members and rear structural Y-shaped members both attached to a pivotal rod whereby said forward Y-shaped structural member and said rear Y-shaped structural member are symmetrical about said pivotal rod;

(b) providing a structural member outboard portion on each side of said forward Y-shaped member and said rear structural Y-shaped member having a cushion supporting structure attached to said structural member outboard portion;

(c) providing one or more upper cushions in a form of airbags or springs and one or more lower cushions in a form of airbags or springs, whereby said cushion supporting structures retain both upper cushions and lower cushions therein;

(d) providing cantilevered vehicle support arms extending outward from said structural member outboard portions having a proximal end and a distal end, whereby said proximal end of said cantilevered support arms are located between said upper cushions and said lower cushions;

(e) providing omni-directional ball-swivel joint housings located on said cantilevered vehicle support arms; and (f) providing passenger vehicles having passenger vehicle axles rotatably attached to said omni-directional ball-swivel joint housings whereby said passenger vehicles rock up and down in said forward structural Y-shaped member and said rear structural Y-shaped member.

13. The method of making a longitudinally spinning suspension roller coaster, according to claim 12, wherein said step of providing said structural member outboard portion on each side of said forward Y-shaped member and said rear structural Y-shaped member further includes the step of providing structural member outboard portions that each support a roller coaster truck movably attachable to a three-member tubular rail system.

14. The method of making a longitudinally spinning suspension roller coaster, according to claim 12, the step of providing upper and lower cushions comprising the step of providing upper springs and lower springs wherein said cushion supporting structures retain both said upper springs and lower springs.

15. The method of making a longitudinally spinning suspension roller coaster, according to claim 12, wherein said step of providing cantilevered vehicle support arms extending outward from said structural member outboard portions further includes the step of providing cantilevered vehicle support arms that are pivotally attached to said structural member outboard portions by pivot pins.

16. The method of making a longitudinally spinning suspension roller coaster, according to claim 12, wherein said step of providing cantilevered vehicle support arms extending outward from said structural member outboard portions further includes the step of providing cantilevered support vehicle arms that pass between said upper cushions and lower cushions to allow for cushioning of said cantilevered vehicle support arms movement.

17. The method of making a longitudinally spinning suspension roller coaster, according to claim 14, wherein said step of providing cantilevered vehicle support arms extending outward from said structural member outboard portions further includes the step of providing cantilevered support vehicle arms that pass between said upper springs and lower springs to allow for cushioning of said cantilevered vehicle support arms movement.

18. The method of making a longitudinally spinning suspension roller coaster, according to claim 12, wherein said step of providing passenger vehicles having passenger vehicle axles rotatably attached to said omni-directional ball-swivel joint housings whereby said passenger vehicles rock up and down limited by the cushioned cantilevered vehicle support arms, and said passenger vehicles remain in an upright position throughout a longitudinal spin of the roller coaster.

19. The method of making a longitudinally spinning suspension roller coaster, according to claim 12, wherein said step of providing said passenger vehicles further includes the step of providing passenger vehicles having a forward direction of travel along a three-member tubular rail system, wherein said passenger vehicle is oriented in said forward direction of travel when attached to said cantilevered vehicle support arms.

20. The method of making a longitudinally spinning suspension roller coaster, according to claim 12, wherein said steps of providing forward structural Y-shaped members and a rear structural Y-shaped members, said structural member outboard portions and said cantilevered vehicle support arms further includes the step of providing forward structural Y-shaped members and a rear structural Y-shaped members, said structural member outboard portions and said cantilevered vehicle support arms that are partially hidden under an ornamental structure.

21. The method of making a longitudinally spinning suspension roller coaster, according to claim 20, wherein said step of providing forward structural Y-shaped members and a rear structural Y-shaped members, said structural member outboard portions and said cantilevered vehicle support arms that are partially hidden under an ornamental structure, further includes the step of providing an ornamental structure which resembles a flying bird.

22. The method of making a longitudinally spinning suspension roller coaster, according to claim 21, wherein said step of providing an ornamental structure which resembles a flying bird, further includes the step of providing an ornamental structure which resembles an eagle.

* * * * *